US005707060A

United States Patent [19]

Ogane et al.

[11] Patent Number: 5,707,060

[45] Date of Patent: Jan. 13, 1998

[54] MEDAL DROPPING GAME MACHINE

[75] Inventors: Takumi Ogane; Toshitake Inagaki; Hiroshi Ono; Yasuo Mori; Naoya Tokuno; Susumu Oaku; Jinichi Matsumoto, all of Tokyo, Japan

[73] Assignee: Namco Limited, Tokyo, Japan

[21] Appl. No.: 608,517

[22] Filed: Feb. 28, 1996

[30] Foreign Application Priority Data

Mar. 1, 1995 [JP] Japan ..... 7-068659

[51] Int. Cl.[6] ..... A63F 7/22

[52] U.S. Cl. ..... 273/138.2

[58] Field of Search ..... 273/440, 448, 273/459, 138.1, 138.2

[56] References Cited

U.S. PATENT DOCUMENTS

| | | | |
|---|---|---|---|
| 4,662,636 | 5/1987 | Crompton | 273/138.2 |
| 5,275,402 | 1/1994 | Malvazos et al. | 273/440 X |
| 5,297,816 | 3/1994 | Becchio | 273/459 |

FOREIGN PATENT DOCUMENTS

| | | |
|---|---|---|
| 63-305 | 1/1988 | Japan . |
| 3-45751 | 9/1991 | Japan . |

*Primary Examiner*—Paul E. Shapiro

*Attorney, Agent, or Firm*—Burns, Doane, Swecker & Mathis, LLP

[57] ABSTRACT

A plurality of medals are placed both on a fixed table and a movable table. A player supplies medals one by one on the movable table via a medal feeding rail. The movable table moves forward and backward in a reciprocating motion to drop medals placed on the fixed table into a medal outlet so as to give the medals to the player. A field table which is placed under the fixed table revolves around a tower, while containing a large number of medals accumulated therein, thereby circulating a large number of accumulated medals. Medals in the field table are automatically taken out, when the amount being in excess, by an overflow prevention device. Thus, the game machine permits the player to continue the game, free from concern about any medal overflowing from the field table.

13 Claims, 11 Drawing Sheets

MEDAL DROPPING GAME MACHINE

BACKGROUND OF THE INVENTION

1. Field of the Invention

The present invention relates to a medal dropping game machine for competing the number of medals got by adjusting the way to select a position on which the medal is supplied and a timing when the medal is supplied.

2. Related Art

Heretofore, there have been known a medal dropping game machine which comprises an immovable fixed table, a movable table moving forward and backward in a reciprocating motion on the fixed table, a medal capturing opening disposed in the vicinity of the fixed table and a medal feeding rail for leading medals either to the fixed table or to the movable table. In this game machine, a plurality of medals are placed in advance on the fixed table and the movable table, and a player supplies medals one by one thorough the medal feeding rail onto the fixed table or the movable table.

The movable table repeats a forward and backward movement relative to the fixed table. Accordingly, if a supplied medal is located on a predetermined position relative to the forward and backward movement of the movable table, one or a plurality of medals drop on the fixed table when the movable table moves backward, and subsequently, several of the plurality of medals on the fixed table are pushed by the movable table to drop into the medal capturing opening when the movable table moves forward. The medal capturing opening usually communicates with a medal taking-out opening which is open in front of the player, and therefore, the medals dropped into the medal capturing opening are offered to the player through the medal taking-out opening.

However, in the above-mentioned conventional medal dropping game machine, it was impossible to show a lot of medals to the player because a game field for storing medals was limited either to the fixed table or to an area slightly larger than the table. As the result, the inciting effect to the player was not enough. To eliminate this inconvenience, the inventor of the present invention has proposed a medal dropping game machine, which has not been publicly known yet, wherein a rotating field table driven by a driving source, such as an electric motor, is disposed under the fixed table and a lot of, about 10,000 medals for instance, are contained in the field table.

Such game machine permits to store a lot of medals in the field table, and a lot of those stored medals circulate fluently under the fixed table and the movable table, as the field table rotates. Seeing a lot of medals in the player's presence, the player is all the more incited to play zealously to catch more medals. In other words, this permits to obtain a display effect to incite the player zealously.

Such a medal dropping game machine having a rotative field table may have the following problems. That is, if the player keeps on playing, the amount of medals accumulated in the field table increases progressively. When the amount of medals exceeds a certain admissible limit, some of the medals overflow from the field table. As a result, various kinds of devices in the game machine may be damaged by such overflowed medals, or medals which should not be awarded to the player may overflow from the field table and drop into the medal capturing opening. In order to solve these problems, a maintenance operator was obliged to continually keep watch on the operation of the medal dropping game machine, and when medals were going to overflow, it was necessary to scoop up medals out of the field table after suspending the operation of the game machine.

SUMMARY OF THE INVENTION

The present invention has been developed so as to solve problems mentioned above and its object is to permit to continuously operate the machine free from concern about any medal overflowing, in regard to a medal dropping game machine of a type to store a lot of medals in a rotative field table.

To accomplish the aforesaid object, the present invention provides a medal dropping game machine comprising an immovable fixed table, a movable table moving forward and backward in a reciprocating motion on the fixed table, a medal capturing opening disposed in the vicinity of the fixed table, and a medal feeding means for leading medals either to the fixed table or to the movable table. The game machine according to the present invention is characterized by further comprising a field table which moves while containing medals, and a medal overflow prevention means for taking out medals in the field table when medals stored in the field table exceed a certain admissible limit in amount.

In playing the medal dropping game, the player supplies medals on either the fixed table or the movable table through the medal feeding means. If supplied medals are located at a preferable position on the fixed table or the movable table, some of medals on the fixed table drop into the medal capturing opening according to the forward and backward movement of the movable table and are offered to the player. When supplied medals do not drop onto a preferable position on the fixed table or the movable table, no medal on the fixed table drops into the medal capturing opening in spite of the forward and backward movement of the movable table, therefore medals remain on the fixed table or drop into the field table.

A lot of medals are accumulated in the field table, and further, circulate fluently under the fixed table and the movable table for instance, according to the rotation of the field table. Seeing a lot of medals in the player's presence, the player is zealously all the more incited in the game to get more medals. In other words, flowing of many medals brings a display effect which prompts the player to play the game.

As the player supplies medals into the game machine, medals increases progressively on the field table in amount. When the amount of medals exceeds a certain admissible limit, the medal overflow prevention means acts to take out automatically a predetermined amount of medals from the field table. By this function, the medal dropping game machine may be operated continuously without worrying about the overflow of medals from the field table.

The field table maybe disposed under or over the fixed table. If the field table is disposed over the fixed table, a lot of medals kept on the field table will be exposed to a position near the sight of the player. As for the movement of the field table, reciprocating motion, circular rotation or various kinds of other motions maybe adopted. In any of these motions, a lot of medals maybe presented to the player effectively. Various kinds of structures maybe devised concretely for the medal overflow prevention means. For instance, a composition may be devised wherein a measuring device for measuring the amount of medals in the field table and a medal discharge mechanism for discharging medals out of the field table. In this composition, an appropriate amount of medals are collected from the field table by operating the medal discharge mechanism when the measuring device detects that the amount of medals reach the admissible limit. However, such a composition is rather large and expensive. To solve this problem, it is preferable to compose the medal overflow prevention means by adopting a medal collection plate disposed aslant from the upper edge of the side wall to a prescribed height in close contact with the inner circumference of the side wall of the field table.

When the medal collection plate in close contact with the inner circumference of the side wall of the field table is adopted, it is preferable that the height position of the edge of the medal collection plate is adjustable in respect of the field table. By adjusting this height position, the admissible limit for starting the collection of medals may be set to any desirable value. Also, the medal collection plate is preferably disposed in close contact with the inner circumference of the side wall of the field table with no gap. To realize such a close contact, the medal collection plate is shaped in advance along the inner circumference of the side wall of the field table, and moreover, the collection plate is pressed against the inner circumference of the side wall of the field table by means of a elastic member, such as a spring.

DETAILED DESCRIPTION OF THE PREFERRED EMBODIMENTS

Figure 1:
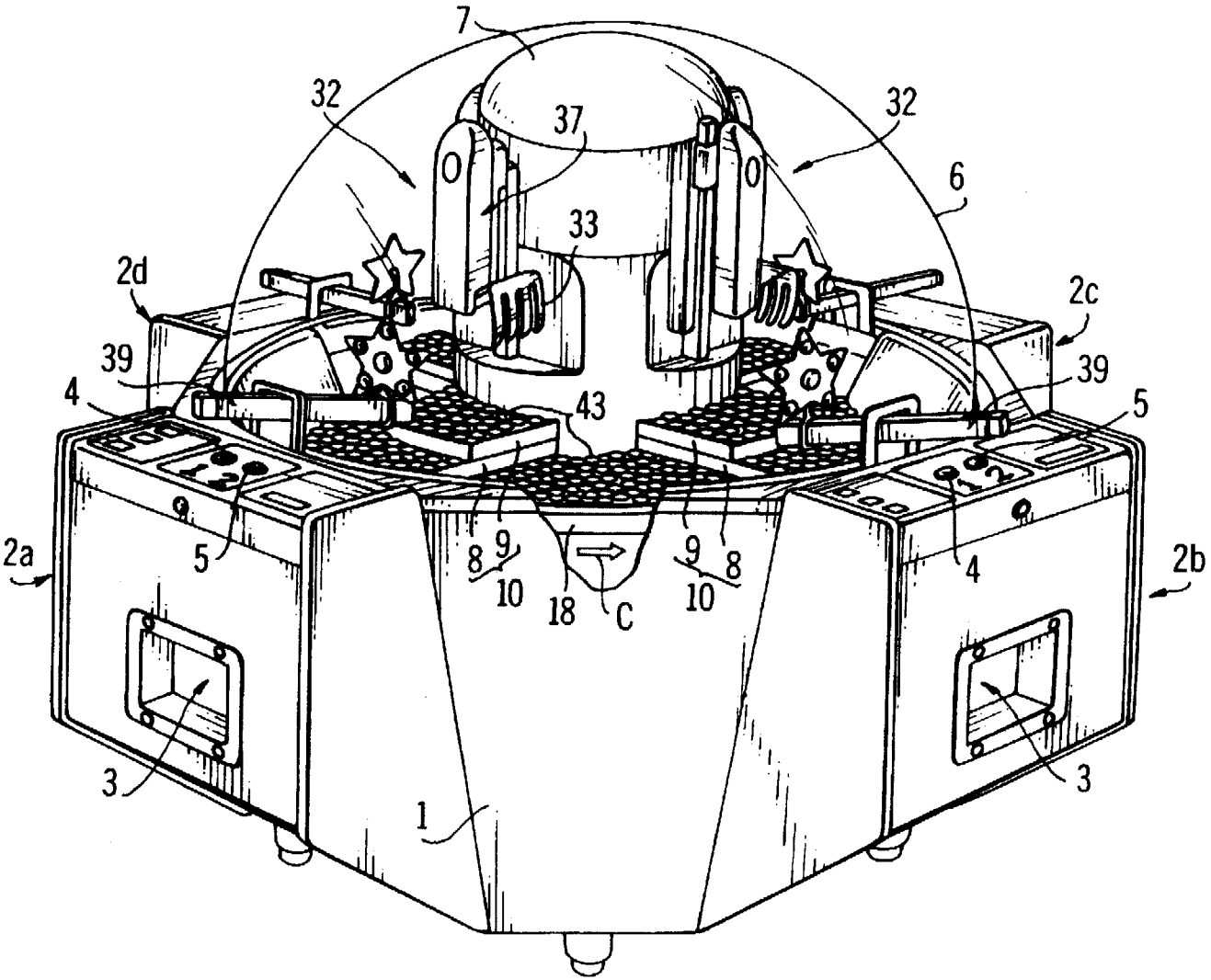
FIG. 1 is a perspective view of an embodiment of the medal dropping game machine according to the present invention.

FIG. 1 illustrates an embodiment of a medal dropping game machine according to the present invention. This medal dropping game machine comprises four game stages 2*a*, 2*b*, 2*c* and 2*d* around a machine casing 1. A medal outlet 3 is disposed respectively at the lower part of each game stage, and two buttons, namely a first button 4 and a second button 5, are arranged on its upper surface, which are used for a bonus game described below. The center portion of the machine casing 1 is covered with a dome-shaped plastic cover 6, and a tower 7 is erected inside the cover 6 at the center thereof.

Figure 3:
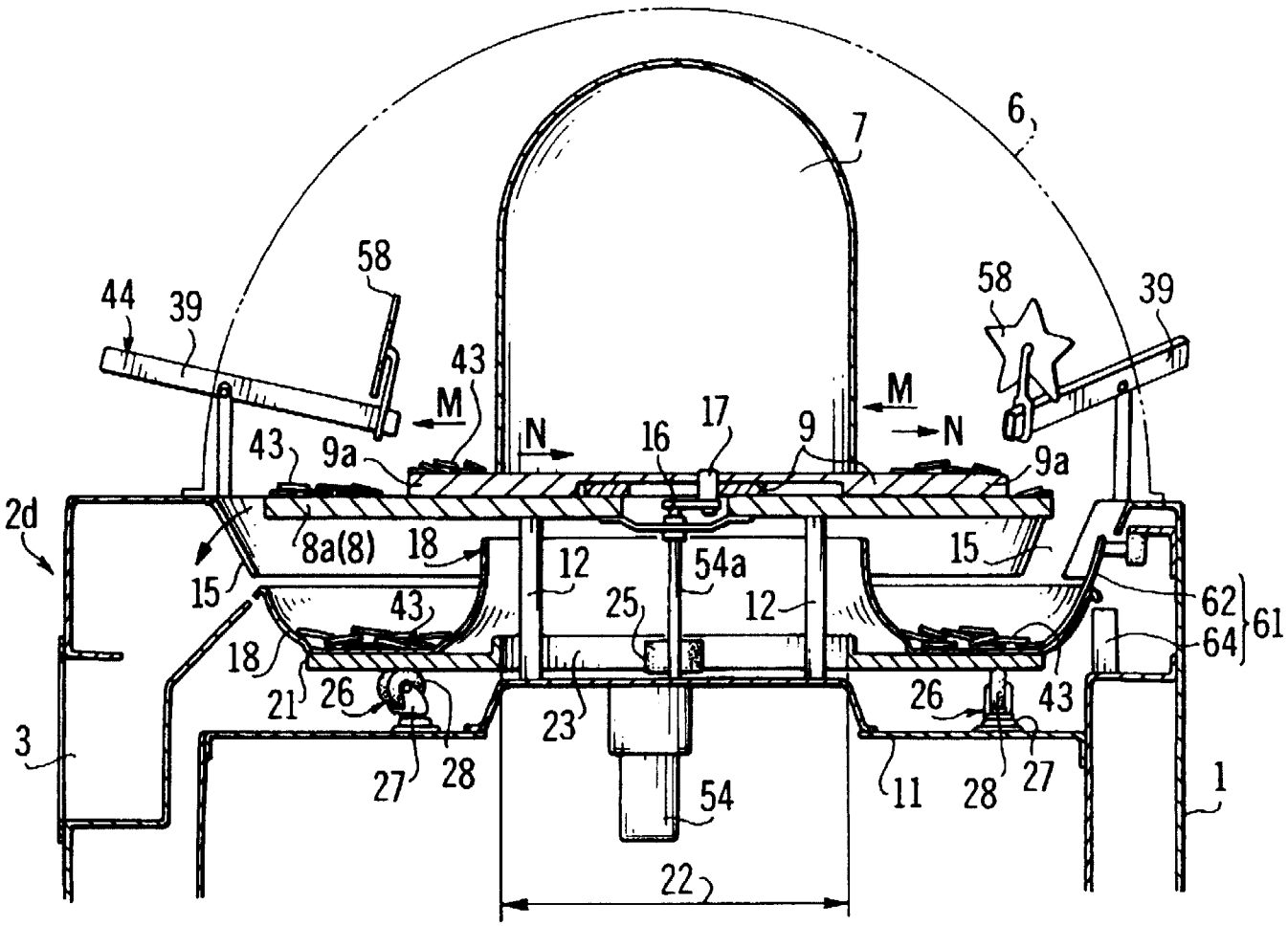
FIG. 3 is a side sectional view as seen along the line III—III of FIG. 2.
Figure 4:
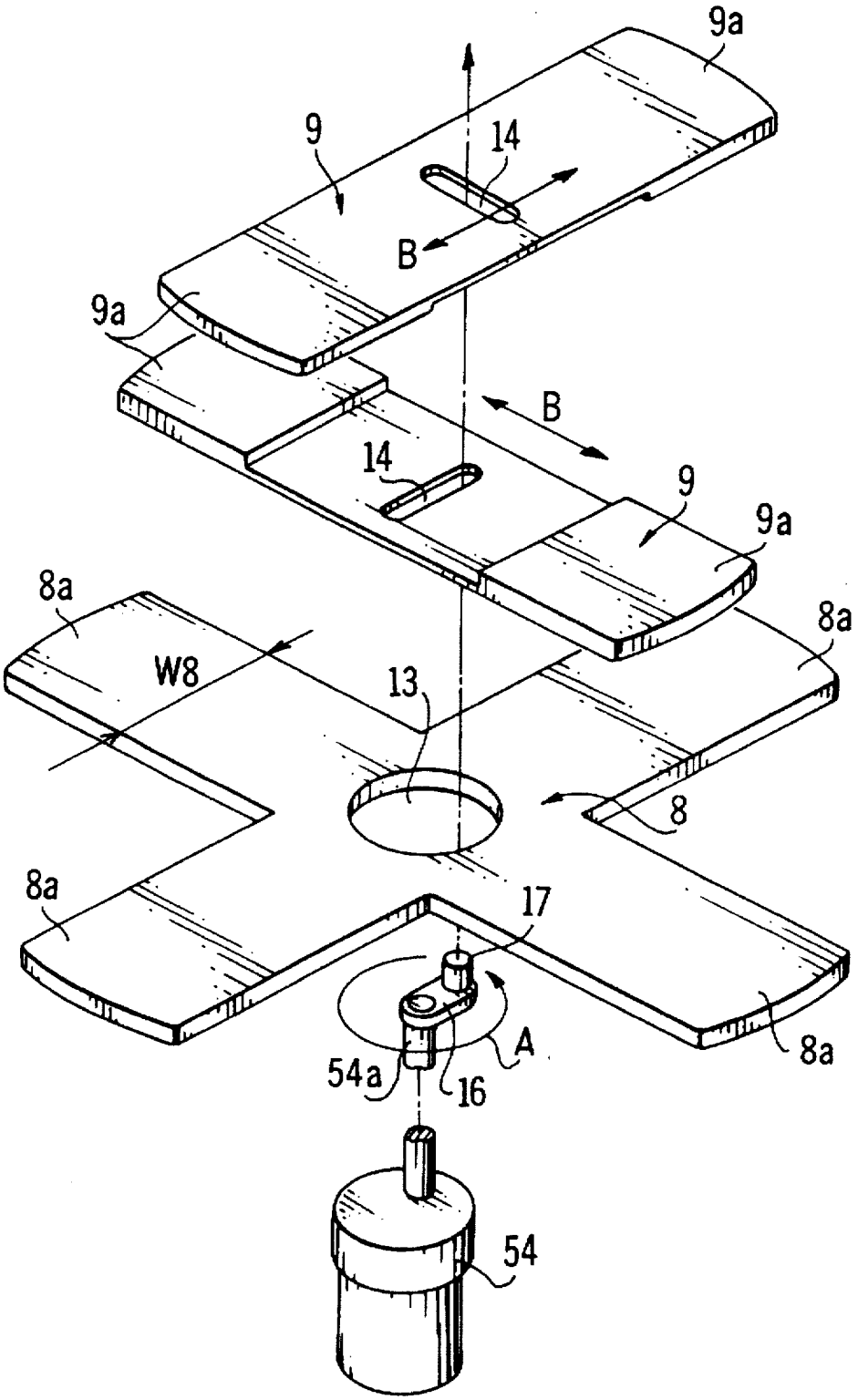
FIG. 4 is an exploded perspective view illustrating an embodiment of the essential part, especially a table unit, of the medal dropping game machine shown in FIG. 1.

The tower 7, as shown in FIG. 3, is fixed immovably to a machine frame 11 disposed in the machine casing 1. Though the drawing does not show a concrete method to affix the tower 7 to the machine frame 11, it maybe affixed by any methods. A fixed table 8 fixed to the machine frame 11 by a support 12 and two movable tables 9 slidably mounted on the fixed table 8 are disposed at the base of the tower 7. The fixed table 8 is substantially formed cruciform as shown in FIG. 4 and, on the other hand, two movable tables 9 are composed of linear plates whose width is substantially equal to the width W8 of the fixed table 8. A through hole 13 is opened at the center of the fixed table 8 and, on the other hand, a long hole 14 is perforated at the center of respective movable tables 9.

Figure 2:
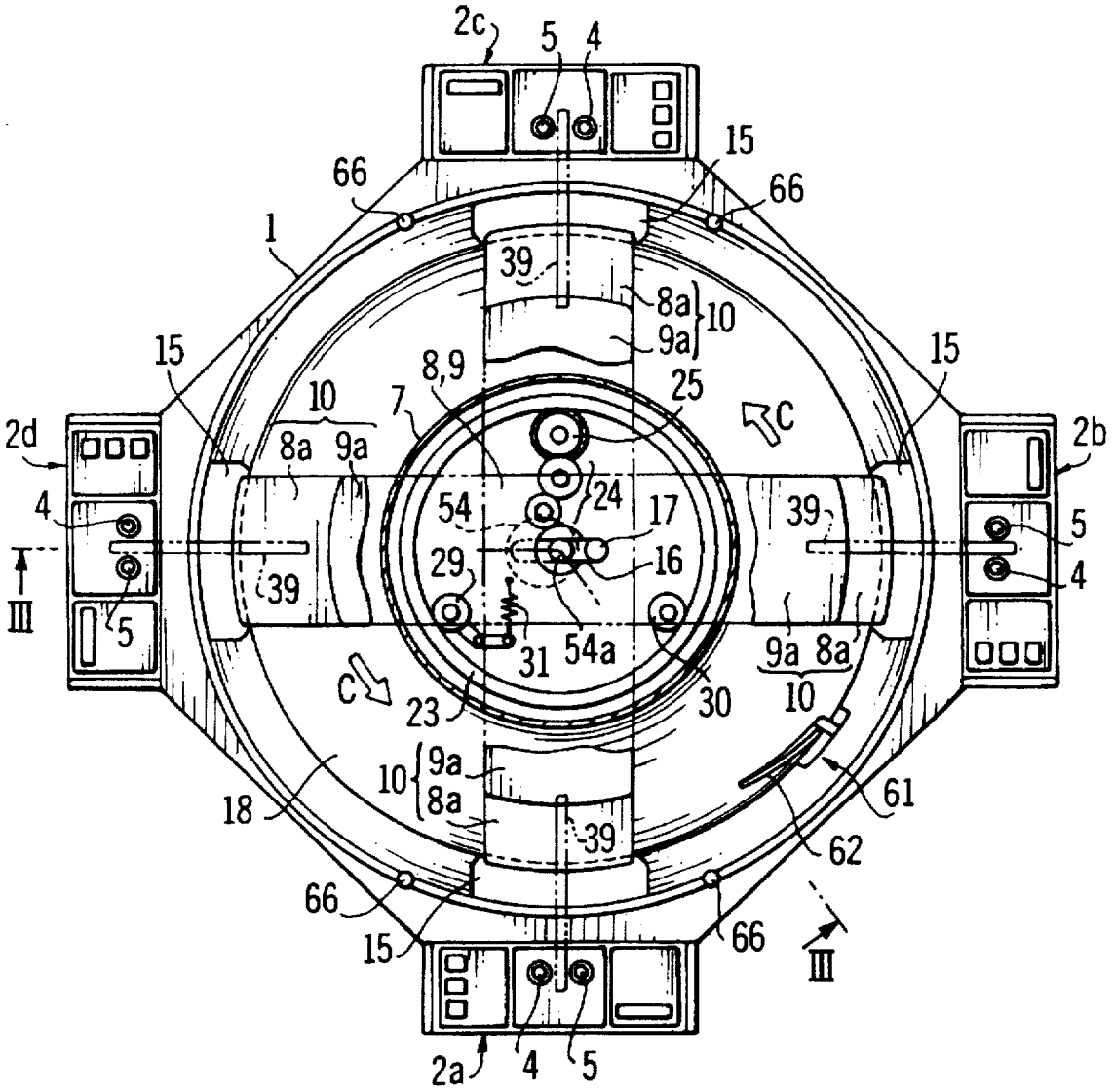
FIG. 2 is a plan view of the same medal dropping game machine.

As shown in FIG. 2, the edge 8*a* of the fixed table 8 and the edge 9*a* of the movable table 9 protrude outside the tower 7. Edges 8*a* and 9*a* of respective tables are positioned corresponding to respective game stages 2*a* to 2*d*. Openings 15 acting respectively as a medal capturing opening are formed at the top of the machine casing 1 corresponding to the respective edges 8*a* of the fixed table 8. These medal capturing openings 15 communicate with medal outlets 3 of respective game stages 2*a* to 2*d* in the machine casing as shown at the left side of FIG. 3. One of edges 8*a* of the fixed table and one of edges 9*a* mounted thereon compose a table unit 10 corresponding to each of game stages 2*a* to 2*d*. As the result, respective table units 10 are arranged radially around the tower 7 in the present embodiment.

Referring to FIG. 3, an electric motor 54 is arranged substantially at the center of the machine frame 11. To the end edge of an output shaft 54*a* of the motor 54, an arm 16 is so attached fixedly as to protrude perpendicular thereto. A roller 17 is so disposed as to rotate free at the end of the arm 16. The roller 17 is fitted into the central long hole 14 of respective movable tables 9 through the central through hole 13 of the fixed table 8 as shown in FIG. 4. When the motor 54 starts to rotate the output shaft 54*a* and thus the roller 17 revolves around the rotation shaft 54*a* as shown by the arrow A, respective movable tables 9 fitted with the roller 17 moves in reciprocating linear movement as shown by the arrow B. Additionally, guide members (not shown) are disposed at both sides of respective movable tables 9 for guiding them to move in a linear movement. Such guide members may be formed by a member for exclusive use arranged around respective movable tables 9, or also by an opening formed at the base of the tower 7 for allowing respective tables 8 and 9 to pass therethrough.

Figure 5:
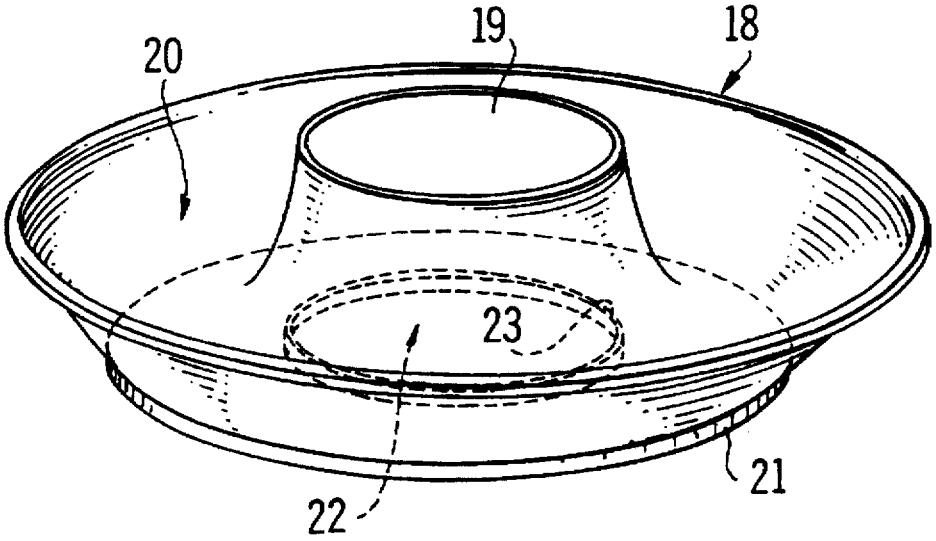
FIG. 5 is a perspective view illustrating an embodiment of the essential part, especially a field table, of the medal dropping game machine shown in FIG. 1.

Referring to FIG. 3, a field table 18 is disposed under the fixed table 8. The field table 18 is made by a plastic molding for instance, has a substantially circular shape as shown in FIG. 5 and has an annular concave portion 20 formed around the central opening 19. Medals to be used for the game are stored in the annular concave portion. Many medals, such as about 10,000 medals, are contained in the concave portion in the present embodiment. An annular bottom plate 21 made of iron or other rigid material is attached to the bottom of the field table 18 by adhesive, screw or other affixing methods. An opening 22 of substantially the same diameter as the central opening 19 of the field table 18 is formed at the center of the bottom plate 21, which has a protruding wall 23 at all around the circumference of the opening 22.

Figure 6:
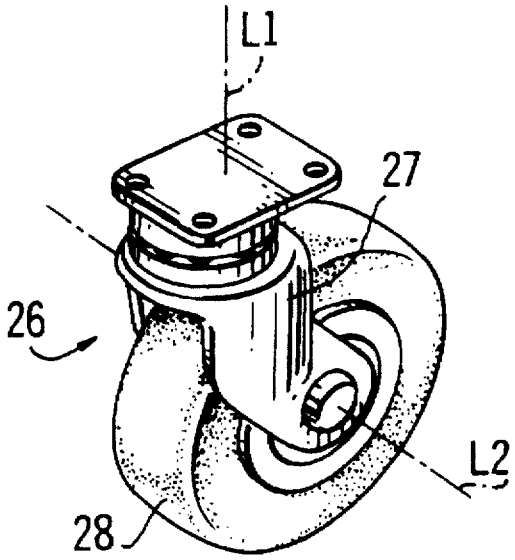
FIG. 6 is a perspective view illustrating a two axial caster for supporting the field table.

Referring to FIG. 3, bi-axial casters 26 are fixed to a plurality of points on the top of the machine frame 11, and the field table 18 is mounted on rollers 28 of the bi-axial casters 26. As shown in FIG. 6, the bi-axial caster 26 is composed of a support frame 27 freely rotative around the frame axis L1 and the roller 28 supported by the support frame 27 so as to rotate freely around the roller axis L2. In the present embodiment, the support frame 27 is affixed to the machine frame 11. The frame axis L1 and the roller axis L2 are orthogonal each other, so that the roller 28 can rotate around the roller axis L2 while changing freely the direction around the frame axis L1.

The rigid bottom plate 21 is disposed at the bottom of the field table 18 for the reasons mentioned below. One is that it serves to support sufficiently the weight when it becomes extremely heavy as more and more medals are stored in the field table 18. The other is that, if the bottom plate 21 is made of wood or other soft material, the contact surface of the bottom plate 21 against the caster roller 28 bends largely, resulting in increasing an area of the contact surface therebetween, so that the bottom plate 21, and consequently, the field table 18 becomes hard to move. On the contrary, if the bottom plate 21 is made of rigid material as in the present embodiment, the contact surface with the caster roller 28 may be kept small so as to allow the field table 18 to move smoothly.

Referring to FIG. 2, a gear train 24 is connected to the output shaft 54*a* of the motor 54 for driving the movable table 9, and a pulley 25 is disposed on the last stage of the gear train 24. The pulley 25 is abutted under a pressure to the inner circumference of the protruding wall 23 of the bottom plate 21 integrated with the field table 18. When the motor 54 is operated to rotate the output shaft 54*a*, rotation is transmitted to the pulley 25 through the gear train 24 to thereby turn the pulley 25. Then, rotation of the pulley 25 is transmitted to the field table 18 by friction, so that the field table 18 turns as shown by the arrow C. In addition, other than the driving pulley 25, an auxiliary pulley 29 pressed by a spring 31 and another auxiliary pulley 30 abut the inner circumference of the protruding wall 23 of the bottom plate 21. The field table 18, therefore, turns in the direction shown by the arrow C around the axis specified by these three pulleys 25, 29 and 30.

Figure 7:
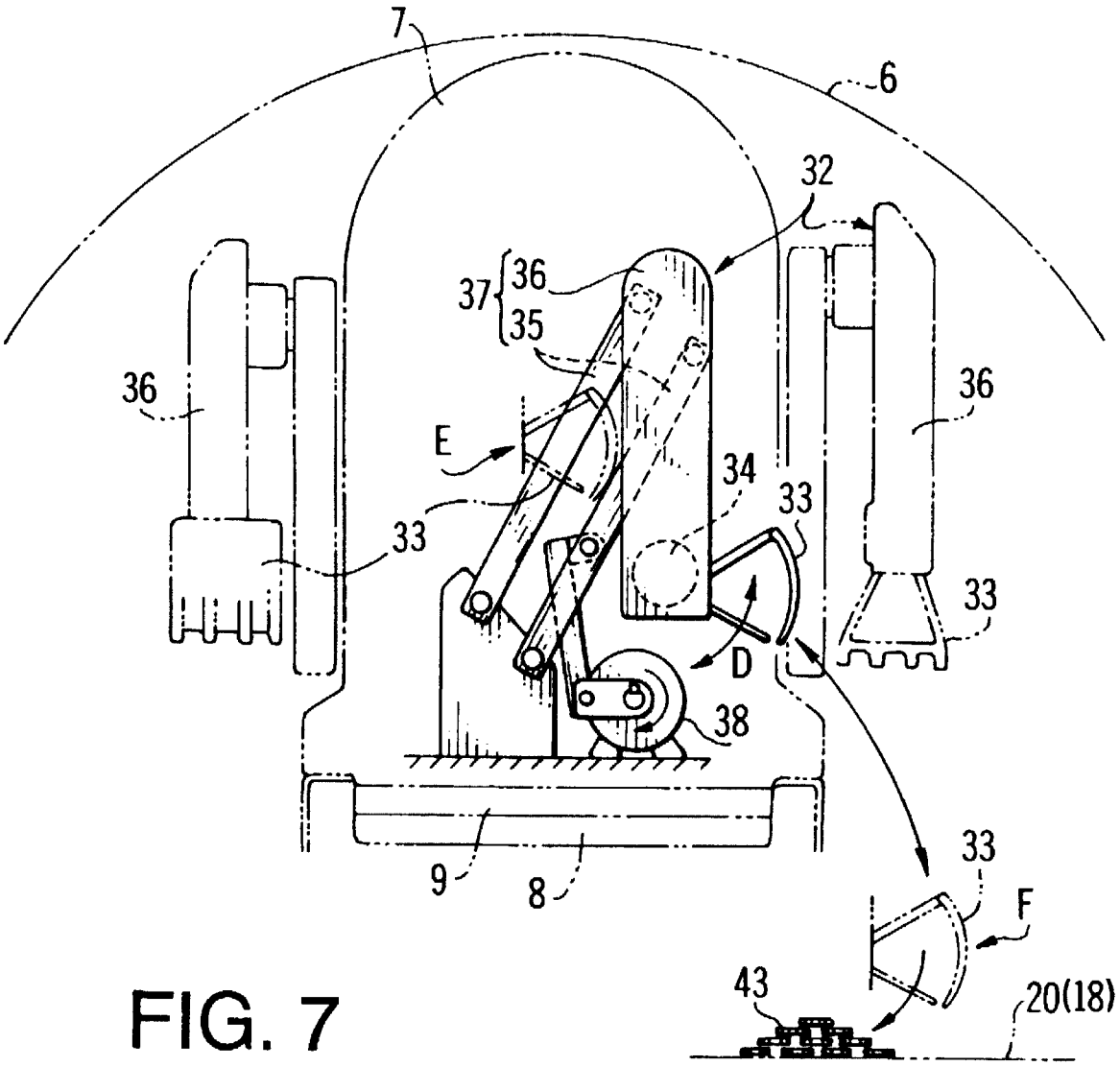
FIG. 7 is a side elevational view illustrating an embodiment of the essential part, especially a medal transport device, of the medal dropping game machine shown in FIG. 1.

Referring again to FIG. 1, medal transport devices 32 are disposed beside the tower 7 corresponding to the respective game stages 2*a* to 2*d*. As shown in FIG. 7, each medal transport device 32 includes an arm 37 composed of a pair of parallel links 35 and a parallel moving member 36 connected to the forward end thereof, and a bucket 33 rotatably supported by the lower end of the parallel moving member 36, namely the forward end of the arm 37. The arm 37 is driven by a motor 38 for arm to transport the bucket 33 between an upper position E and a lower position F. The upper position E corresponds to a position where the bucket 33 is placed above the movable table 9. The lower position F corresponds to a position where the bucket 33 is placed just above the concave portion 20 of the field table 18. The bucket 33 is driven by a motor 34 for bucket mounted at the lower end of the parallel moving member 36 to turn reciprocally as shown by the arrow D. When the bucket 33 turns to the lower position, medals 43 are taken up into the bucket. On the other hand, when the bucket 33 rotates to the upper position, medals 43 drop from the bucket.

Figure 8:
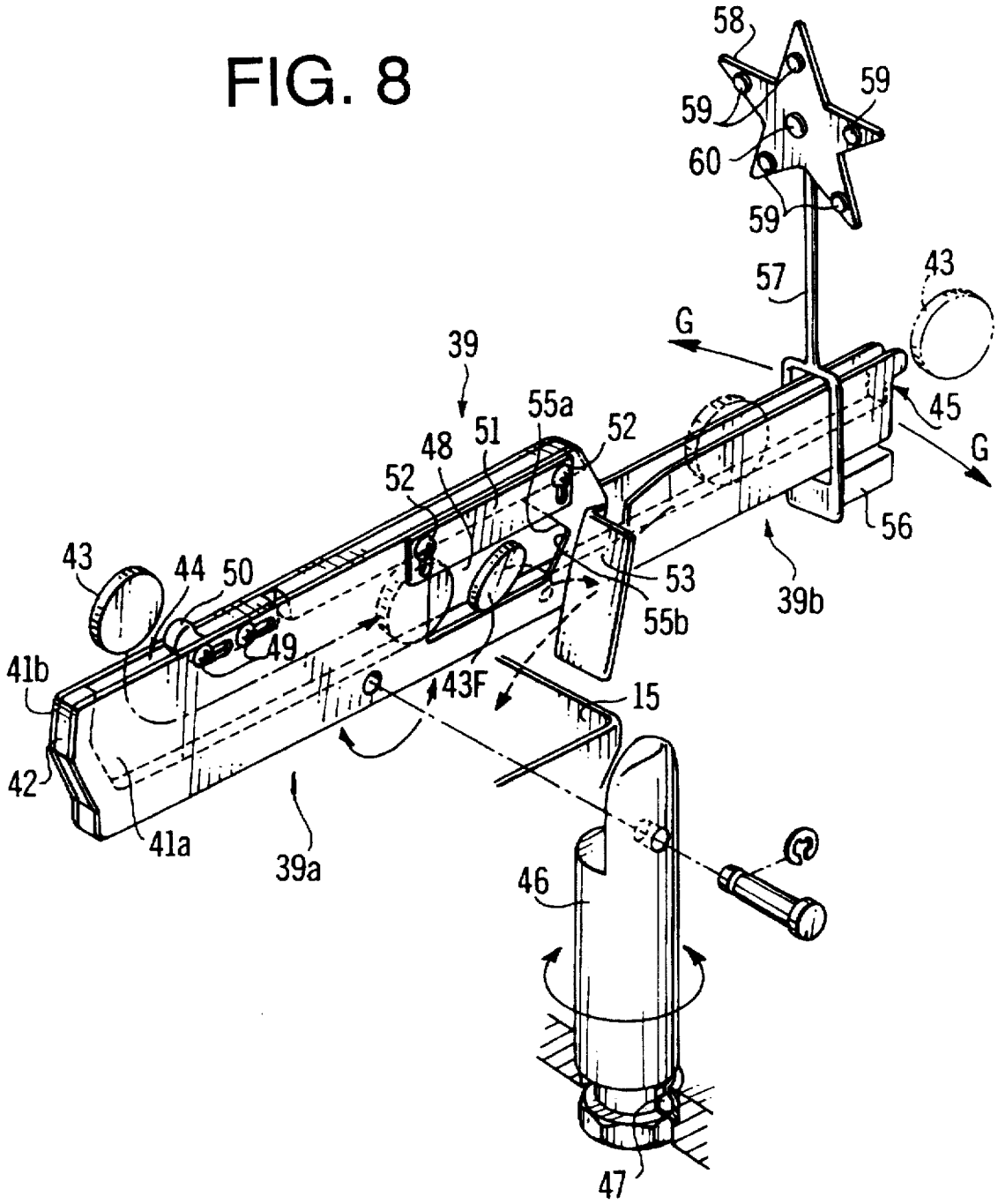
FIG. 8 is a perspective view illustrating an embodiment of the essential part, especially a medal feeding device, of the medal dropping game machine shown in FIG. 1.

Referring to FIG. 1, a medal feeding rail 39 is disposed respectively in each game stage 2*a* to 2*d*. The medal feeding rail 39, as shown in FIG. 8, is formed by combining side plates 41*a* and 41*b* with each other through a spacing member 42. Medals 43 are introduced into the rail through a medal input opening 44, and then slide or roll down in a space formed by the spacing member 42 to drop outside from a medal dropping opening 45. The dropped medal 43 gets on either the movable table 9 or the fixed table 8. The medal drop opening 45 my be placed over the movable table 9 or over the fixed table 8. In the present embodiment, the opening 45 is supposed to be placed over the movable table 9. The medal input opening 44 is formed by a chip 50 whose position my be adjusted by screws 49. By adjusting the position of the chip 50, the opening width of the medal input opening 44 may be set substantially equal to the diameter of the medal 43 so as to prevent a defective medal having a diameter larger than the specified diameter from being introduced into the rail by mistake or intentionally.

The medal feeding rail 39 is composed of a slant rail portion 39*a* and an upright rail portion 39*b* being in succession thereto. The medal feeding rail 39 is disposed on the machine casing 1 of the game machine (shown in FIG. 1) by attaching the slant rail portion 39*a* to a supporting post 46. The supporting post 46 is rotatably supported by a bearing 47, so that the whole rail 39 may swing in left and right directions, namely in a transverse direction, around the supporting post 46 as shown by the arrow G. The swing of the rail in a transverse direction allows to vary the drop position of the medal 43 as the player expects.

Figure 9:
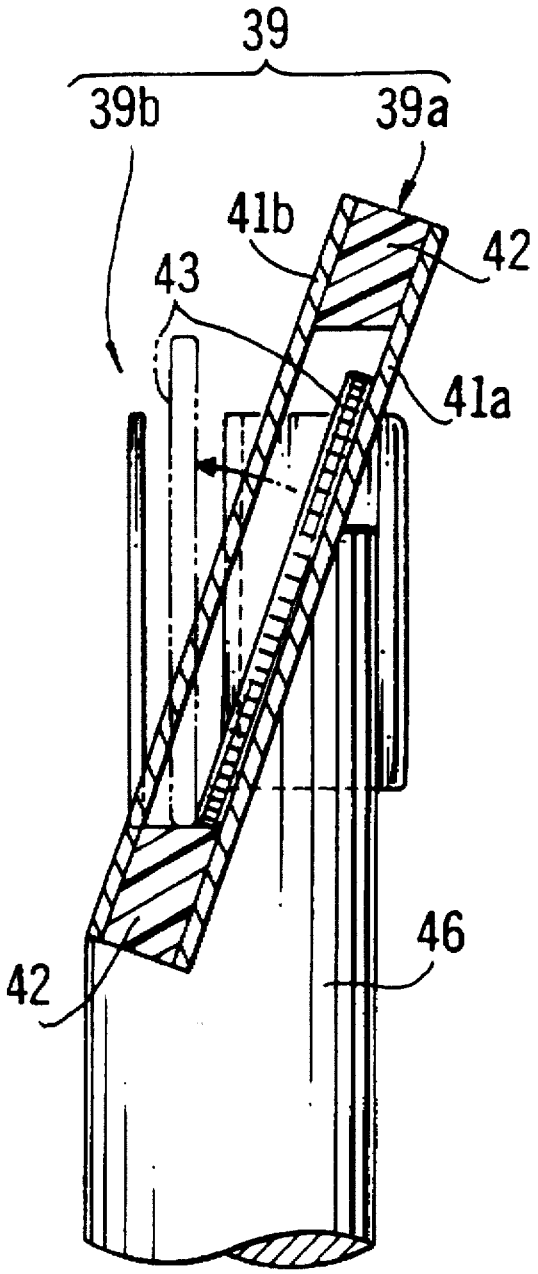
FIG. 9 is a sectional view of the same medal feeding game machine.

The slant rail portion 39*a* of the medal feeding rail 39 may be inclined either to the right or to the left, especially to the right in the present embodiment as shown in FIG. 9. The upright rail portion 39*b* is directed vertically without slanting as shown in the drawing. A long aperture 48 for selecting a suitable medal is opened on the side plate 41*a* located in the inclined side of the slant rail portion 39*a* as shown in FIG. 8. A side chip 51 serving as the upper side of the long aperture 48 may be adjusted in height by screws 52. The height of the long aperture 48 is set less than the diameter of the specified medal 43, so that, when a defective medal 43F having a diameter smaller than the specified value is introduced into the medal input opening 44 by mistake or intentionally, the defective medal 43F drops outside through the long aperture 48 to be prevented from rolling into the upright rail portion 39*b*. Thus dropped defective medal 43F subsequently hits a protruding plate 53, and then, is collected to the medal capturing opening 15. Thus, defective medals having a smaller diameter are prevented from being used for the game.

The reason that side plates 41*a* and 41*b* of the slant rail portion 39*a* are inclined is that medals 43 and 43F should roll down in contact with the inner surface of the side plate 41 *a* having the long aperture 48. The upright rail portion 39*b* is designed to correct the posture of the rolling down medal 43 from a slanting position to an upright position. If the medal 43, still being held in slanting position, drops from the medal drop opening 45 onto the movable table 9, the movement of the dropped medal 43 becomes unstable so that it would be difficult for the player to place the medal 43 exactly on a desired position. On the contrary, if the medal 43 is corrected to be in the vertical direction by the upright rail portion 39*b*, the drop position of the medal 43 onto the movable table 9 may be controlled exactly.

Additionally, at the forward edge portion of the long aperture 48 for sorting defective medals, two slant sides 55*a* and 55*b* are formed respectively in the upper and lower positions. The medal 43 rolling down in the rail tends to swing in left and right directions when it passes along the long aperture 48. The forward edge portion of the long aperture 48 being simply formed into a linear shape extending upward and downward, that is, the long aperture 48 being formed into a simple rectangle, is considered to cause a problem in that medals rolling down while swinging in left and right directions may hit the edge portion of the aperture 48 and stop there, to thereby plug the rail with following medals. On the contrary, if the forward edge portion of the long aperture 48 is composed of slant sides 55*a* and 55*b* as in the present embodiment, medals rolling down while swinging in left and right directions are directed progressively to the inside of the rail by the slant sides 55*a* and 55*b*, and thus, medals can completely be avoided to accumulate at the long aperture 48.

At the forward end of the medal feeding rail 39, to be more specific, at the forward end of the upright rail portion 39*b*, is attached a medal sensor 56 composed of a optical sensor, a mechanical sensor or other detecting elements. This medal sensor 56 detects the medal 43 rolling down in the upright rail portion 39*b* and emits a detection signal, namely a electric signal. A star-shaped illumination plate 58 is attached to the end of the upright rail portion 39*b* by a support 57. Five peripheral light-emitting diodes 59 capable of emitting selectively yellow or red light and one central light-emitting diode 60 emitting red monochromatic light are disposed on the surface of the illumination plate 58. These light-emitting diodes are prepared for indicating a hit or a failure of the bonus game, which will be described in detail below.

Figure 10:
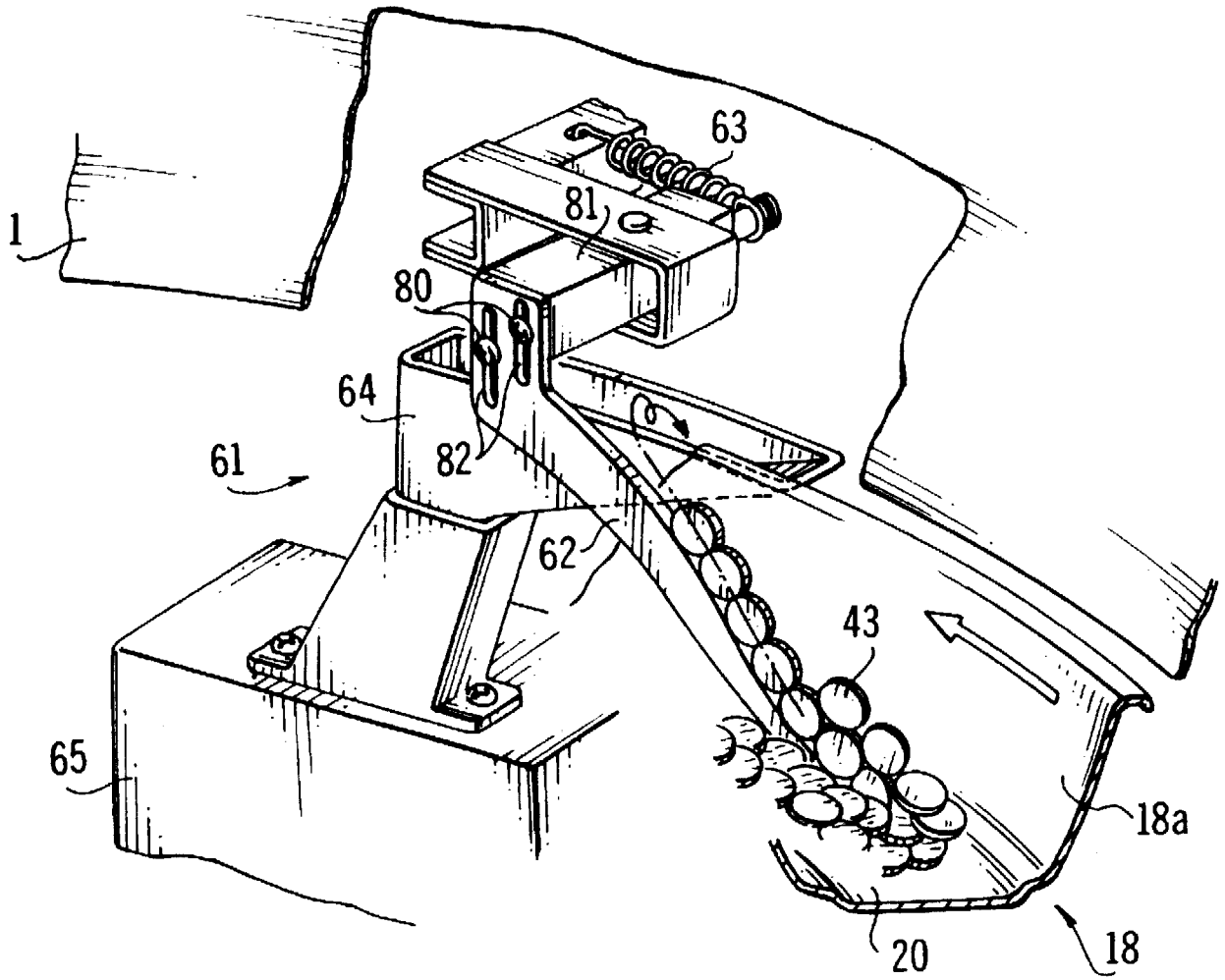
FIG. 10 is a perspective view illustrating an embodiment of the essential part, especially a medal overflow prevention device for preventing medals to overflow, of the medal dropping game machine shown in FIG. 1.

Referring again to FIG. 2, a medal overflow prevention device 61 is disposed on a certain position (shown in the right and lower portion in the drawing) on the top of the machine casing 1 for preventing medals from overflowing the field table 18 to enter the medal capturing opening 15 or to drop inside of the machine casing 1. As shown in FIG. 10, the medal overflow prevention device 61 includes a long nail-shaped medal collection plate 62 abutting the inner circumference 18*a* of the outer side wall of the field table 18, a compression spring 63 for pressing the medal collection plate 62 against the inner circumference 18*a* of the side wall of the field table, and a hopper 64 for collecting medals.

The medal collection plate 62 extends slantly downward from the upper end of the inner circumference 18*a* of the side wall of the field table to an appropriate position. The thickness of the medal collection plate 62 is set about the thickness of the medal 43. In the present embodiment, the inner circumference 18*a* of the side wall of the field table is not shaped into a simple linear section but curved. The medal collection plate 62 is formed beforehand in a curved shape according to the curved shape of the field table, and further pulled by the spring 63, so that the plate 62 is pressed against the inner circumference 18*a* of the side wall of the field table to be in closely contact therewith without any gap.

As the game goes on, more and more medals 43 are stored in the concave portion 20 of the filed table 18. When the amount of medals attains a certain admissible limit, some of medals ride over a medal collection plate 62 and are pushed up before falling into a collection hopper 64. Medals fallen into the hopper are delivered to a medal box 65 disposed at an appropriate place in the machine casing 1 (shown in FIG. 1) and collected therein. Thus, since the excessive amount of medals 43 are taken out of the field table 18 by the medal collection plate 62, medals in the field table 18 may not drop in error into the medal capturing opening 15 or inside the machine casing 1 even if medals in the field table 18 increase in amount as the game goes on.

The medal collection plate 62 is fixed to a support member 81 by screws 80 at the upper end thereof. long openings 82 are perforated at the fixing portion of the medal collection plate 62 for adjusting the height of the collection plate 62, especially the height of the forward end of the collection plate 62, relative to the field table 18 when screws 80 are tighten. By adjusting the height of the forward end of the collection plate 62 relative to the field table, the limit position for starting the collection of medals 43, namely a certain acceptable limit for medals 43, can be adjusted.

Figure 11:
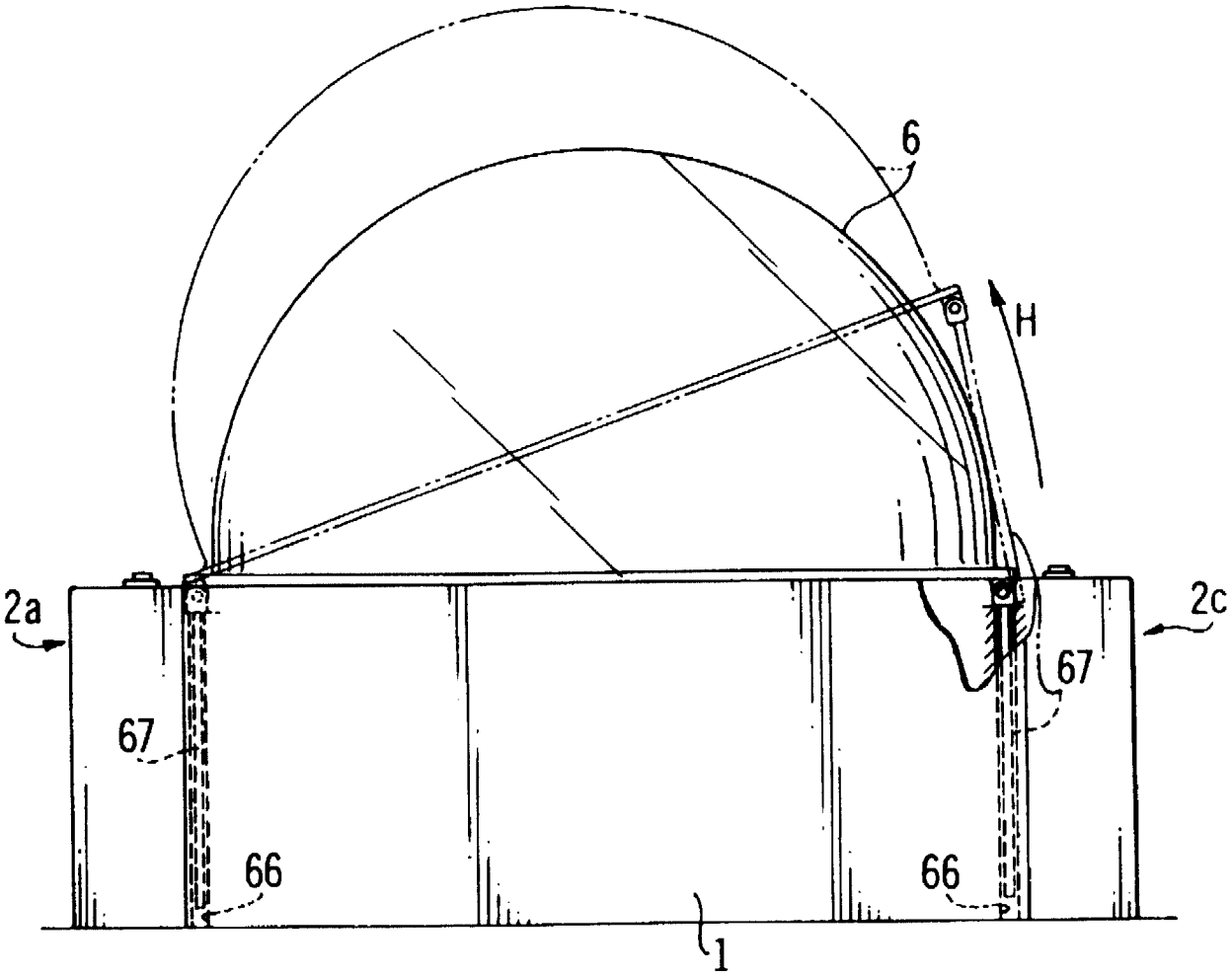
FIG. 11 is a schematic view illustrating a cover to be opened and closed in the medal dropping game machine shown in FIG. 1.

Referring to FIG. 2, a pair of holes 66 are provided on the top of the machine casing 1 and at both sides of the game stages 2*a* and 2*c*. As shown in FIG. 11, support rods 67 suspended from the lower end of the transparent cover 6 are received in these holes. When the cover 6 is lifted up in the direction shown by the arrow H with taking a certain point on the side of the game stage 2*a* as a fulcrum, the lower edge of the cover 6 at the side of the game stage 2*c* opens upward exposing the support rod 67 over the machine casing 1. By latching the lower end edge of support rods 67 to a predetermined position of the top of the machine casing 1 when the cover 6 is completely lifted up, the cover 6 is supported by the support rod 67 to be kept open even if the operator release his hold of the cover. In this state, the operator may perform various kinds of maintenance operations on the field in the cover 6. The cover 6 is lifted up at the side of the game stage 2*c* in the above description, however, the cover 6 may be lifted up similarly at the opposite side, namely at the side of the game stage 2*a*, instead.

Figure 12:
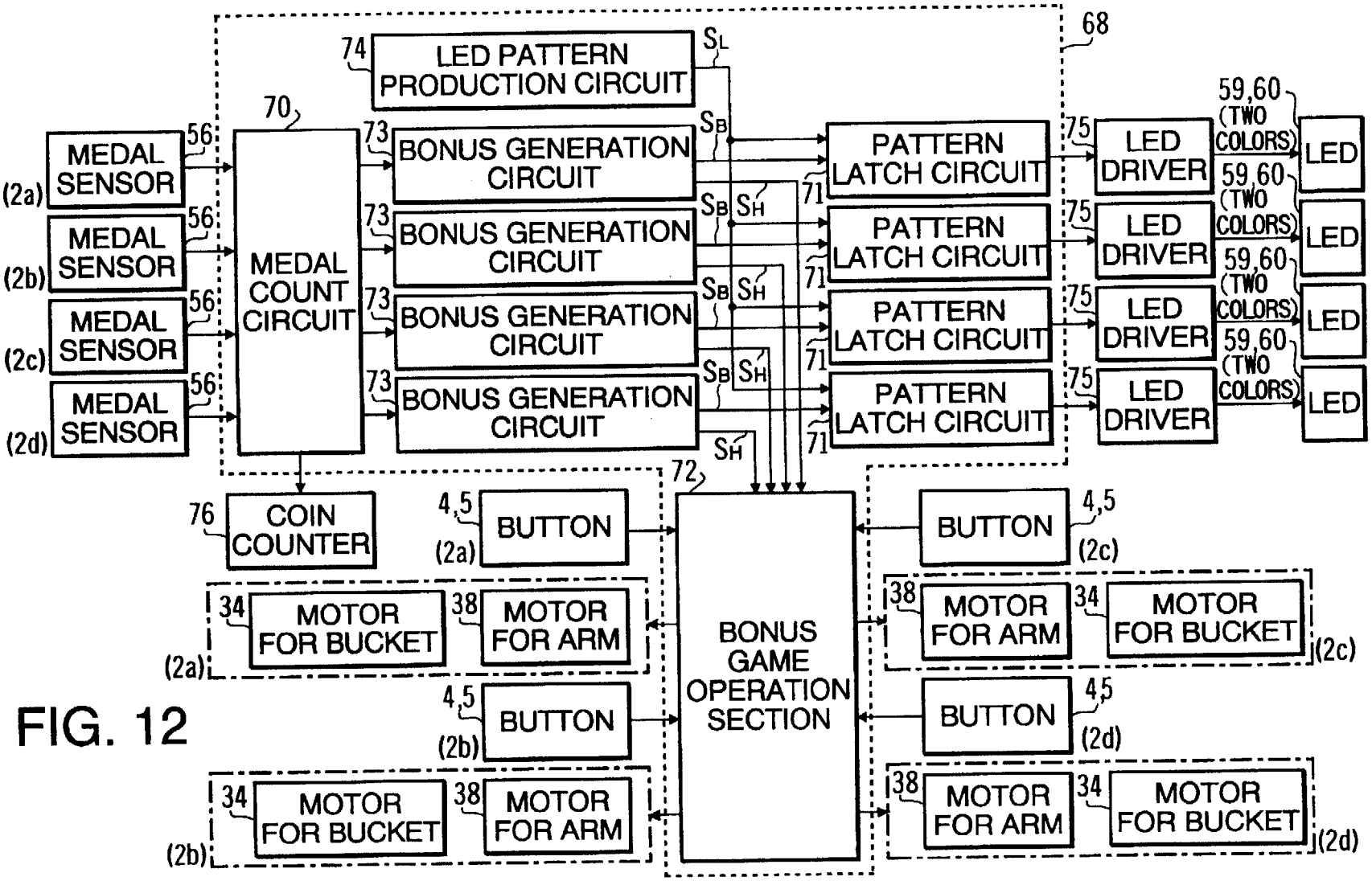
FIG. 12 is a circuit block diagram showing an embodiment of an electric control system of the medal dropping game machine shown in FIG. 1.

FIG. 12 illustrates the essential part of an example of the electric control system adopted for the present embodiment. A control device 68 shown in the figure is composed of a micro-computer for instance, and disposed at an appropriate place in the machine casing 1 (shown in FIG. 1). To be described by the use of functional blocks, as shown in the drawing, the control device 68 includes a medal count circuit 70, bonus generation circuits 73 prepared corresponding to respective game stages 2*a* to 2*d*, pattern latch circuits 71 prepared similarly corresponding to respective game stages 2*a* to 2*d*, a light-emitting pattern generator circuit 74 for delivering a pulse signal $S_L$ at a constant cycle for blinking peripheral light-emitting diodes 59 mounted on the illumination plate 58 (shown in FIG. 8) and a bonus game operation section 72 for operating the bonus game.

The medal count circuit 70 delivers a count signal upon the reception of medal detection signal from the medal sensor 56 (see FIG. 8) disposed on the respective game stages 2*a* to 2*d*. Each bonus generation circuit 73 produces a bonus timing reference signal $S_B$ composed of pulse signals consecutive in a constant cycle, and subsequently delivers it to the pattern latch circuit 71. At the same time, the bonus generation circuit 73 outputs a bonus generation signal $S_H$ to the bonus game operation section 72 when the timing of the count signal from the medal counter section 70 occurs concurrently with this bonus timing reference signal $S_B$. The count signal delivered from the medal count circuit 70 is also sent to a coin counter 76 disposed at a appropriate place in the machine casing 1 (shown in FIG. 1). The coin counter 76 is of a type for counting up one by one the value indication each time the count signal is received. The maintenance operator may confirm the number of medals introduced into the game machine by the player by checking the count up value indicated on the coin counter 76.

Each pattern latch circuit 71 receives a pulse signal $S_L$ from the light-emitting pattern generator circuit 74 and a pulse signal $S_B$ from the bonus generation circuit 73, and then, latches these signals at a cycle interval appropriate for the operation of respective light-emitting diode drivers 75 located at the later stage before outputting them. Then, the peripheral light-emitting diodes 59 and the central light-emitting diode 60 emit light in an on-and-off manner according to the output signal from the respective pattern latch circuits 71.

To the bonus game operation section 72 for receiving the bonus generation signal $S_H$ from the bonus generation circuit 73, are connected input devices, such as first buttons 4 and second buttons 5 disposed respectively on the game stages 2*a* to 2*d*, and further connected output devices, such as motors 38 for arm and motors 34 for bucket corresponding to the respective game stages 2*a* to 2*d*. Based on reception of the bonus generation signal $S_H$, the bonus game operation section 72 starts the operation for the bonus game, to thereby control motors 38 for arm and motors 34 for bucket according to a procedure stored as an algorithm in a predetermined memory.

The medal dropping game machine having the aforementioned composition will now be described how to be operated. In FIGS. 1 and 3, the player stands in front of any one of respective game stages 2*a* to 2*d*. With a lot of, about 10,000 for instance, medals 43 stored in the field table 18, the field table 18 is driven by the motor 54 for the table to turn around the tower 7. Such a turning motion of the field table makes a lot of medals 43 circulate fluently under the fixed table 8. Seeing this, the player may be absorbed in playing the game more zealously as compared with the conventional medal dropping game machine wherein fewer medals are placed on the game field. Moreover, showing a lot of circulating medals to watchers, more watchers may be attracted by the game.

When the motor 54 for the table is operated to rotate, two movable tables 9 also move forward and backward individually on the fixed table 8 as shown by the arrows M and N in FIG. 3 while the field table 18 revolves around the tower. The player introduces medals given beforehand one by one into the medal input opening 44 of the medal feeding rail 39 for supplying one or more medals 43 on the movable table 9. At this time, on the illumination plate 58, five peripheral light-emitting diodes 59 emit yellow light individually in an on-and-off manner and the central light-emitting diode 60 emits red light in an on-and-off manner with a predetermined cyclic interval. The red light emitting of the central light-emitting diode 60 indicates such a specific moment of time that if a medal 43 is detected by the medal sensor 56 located at the forward end of the rail simultaneously with occurrence of the red light emitting of the diode 60, a bonus game will be given to the player.

(Normal medal dropping game)

A normal mode of the game which does not generate a bonus game will now be described. Assuming that the medal 43 supplied by the player, as in FIG. 1, through the medal feeding rail 39 drops on an inappropriate position on the movable table 9, medals 43 on the fixed table 8 remains on the table or falls into the field table 18 without entering the medal capturing opening 15 (shown in FIG. 2) even if the movable table 9 repeats forward and backward movement. As a result, no medal is fed into the medal outlet 3.

On the other hand, if the medal 43 supplied through the medal feeding rail 39 drops on an appropriate position on the movable table 9, when the movable table 9 moves backward toward the tower 7, one or several medals 43 are pushed by the base portion of the tower 7 to fall on the fixed table 8. Thereafter, when the motion of the movable table 9 changes over to the forward movement toward the player, medals 43 on the fixed table 8 are pushed by the forward end of the movable table 9, and thus, one or several medals drop into the medal capturing opening 15. Such fallen medals slide down to the medal outlet 3 to be offered to the player.

The player may change the position on which the medal 43 drops by turning the medal feeding rail 39 by a desired angle in left and right directions as shown by the arrow G in FIG. 8.

(Bonus game)

Referring to FIG. 8, if the medal sensor 56 detects the introduced medal 43 at the time moment simultaneous with the light emitting of the central light-emitting diode 60 on the illumination plate 58, the bonus generation circuit 73 shown in FIG. 12 generates the bonus generation signal $S_H$, on the basis of which a bonus game will be performed according to the operation by the bonus game operation section 72. At this moment, the peripheral light-emitting diodes 59 shown in FIG. 8 change in color from yellow to red for indicating that the bonus game is given to the player.

When a bonus game is afforded, a pushing operation of the first button 4 and the second button 5 in the corresponding game stages 2*a* to 2*d* are activated for allowing, for instance, to press the first button 4 for giving one full turn of the motor 38 for arm (shown in FIG. 7) to permit one cycle of lifting operation of the arm 37. In such a lifting operation, the bucket 33 goes down from the upper stand-by position E to the lower scooping position F, then pauses there before returning to the stand-by position E and terminating the operation. When the bucket 33 descends to the scooping position F, the motor 34 for bucket turns on to swing the bucket 33 downward for scooping up medals 43 in the field table 18. At this moment, the number of medals to be scooped up by the bucket changes variously according to the accumulation state of medals 43 in the field table 18.

When the bucket 33 which has scooped up several medals 43 moves, as it is, to the stand-by position E positioned over the movable table 9 and pauses there, provided that the player presses the second button 5, the motor 34 for bucket turns backward to swing the bucket 33 upward, and thus, medals 43 in the bucket 33 fall onto the movable table 9. Since a plurality of medals 43 may certainly scooped up in the bucket 33, it may well be that the movable table 9*a* receives a plurality of medals thereon, so that rather plenty of medals may very probably offered to the player by forward and backward movement of the movable table 9.

(Operation for Preventing Overflow of Medals)

Referring to FIG. 1, the player standing in front of any one of the game stages 2*a* to 2*d* introduces medals one after another thorough the medal feeding rail 39. Thus, in FIG. 3, the amount of medals in the field table 18 increases progressively. If no measure is taken, medals 43 overflowing from the field table 18 may enter the medal capturing opening 15 and be offered to the player, resulting in spoiling the game.

In the present embodiment, however, as shown in FIG. 10, the medal overflow prevention device 61 is disposed on the side wall, especially on the outer side wall of the field table 18 in order to collect medals 43 overflowing from the field table 18 into the medal box 65 disposed inside the machine casing through both the medal collection plate 62 and the hopper 64. Therefore, even if players introduce a lot of medals one after another, the game my be continued constantly. Moreover, only one medal overflow prevention device 61 disposed around the field table 18 would be enough for preventing the overflow of medals, so that there is no need of enlarging the size of the whole game machine and requiring useless expenses.

While there has been described what are at present considered to be preferred embodiments of the present invention, it will be understood that various modifications may be made thereto, and it is intended that the appended claims cover all such modifications as fall within the true spirit and scope of the invention. For instance, the number of game stages is not limited to four, and one or a plural number other than four can be adopted. Moreover, the medal overflow prevention device 61 shown in FIG. 10 may be disposed at several places in the field table 18.

What we claim is:

1. A medal dropping game machine provided with an immovable fixed table, a movable table moving forward and backward in a reciprocating motion on said fixed table, a medal capturing opening disposed in the vicinity of an edge of said fixed table, and a medal feeding means for leading a medal to said fixed table or said movable table, comprising:

a field table moving while containing the medal; and a medal overflow prevention means for taking said medal out of said field table when the amount of medals accumulated in said field table exceeds a certain tolerance.

2. The medal dropping game machine according to claim 1, wherein said field table is disposed under said fixed table.

3. The medal dropping game machine according to claim 1 or 2, wherein said field table revolves.

4. The medal dropping game machine according to claim 3, wherein said medal overflow prevention means comprises a medal collection plate which is disposed on a slant from an upper end edge of a side wall of said field table to a predetermined height while remaining in close contact with an inner circumferential face of said field table.

5. The medal dropping game machine according to claim 4, wherein the forward end of said medal collection plate is adjustable in height relative to said field table.

6. The medal dropping game machine according to claim 5, further comprising an elastic member elastically pressing said medal collection plate against said inner circumferential face of said field table.

7. The medal dropping game machine according to claim 6, wherein said medal overflow prevention means leads a medal taken out of said field table into a medal box disposed in a machine casing.

8. The medal dropping game machine according to claim 4, further comprising an elastic member elastically pressing said medal collection plate against said inner circumferential surface of said field table.

9. The medal dropping game machine according to claim 1 or 2, wherein said medal overflow prevention means comprises a medal collection plate which is disposed on a slant from an upper end edge of a side wall of said field table to a predetermined height while remaining in close contact with an inner circumferential face of said field table.

10. The medal dropping game machine according to claim 9, wherein the forward end of said medal collection plate is adjustable in height relative to said field table.

11. The medal dropping game machine according to claim 10, further comprising an elastic member elastically pressing said medal collection plate against said inner circumferential surface of said field table.

12. The medal dropping game machine according to claim 9, further comprising an elastic member elastically pressing said medal collection plate against said inner circumferential surface of said field table.

13. The medal dropping game machine according to claim 1, wherein said medal overflow prevention means leads a medal taken out of said field table into a medal box disposed in a machine casing.

* * * * *